US006692106B2

(12) United States Patent
Aizawa et al.

(10) Patent No.: US 6,692,106 B2
(45) Date of Patent: Feb. 17, 2004

(54) DROPLET EJECTOR AND LIQUID SUPPLY TUBE

(75) Inventors: Jyunichi Aizawa, Tokyo (JP); Hiroshi Fukumoto, Tokyo (JP); Munehisa Takeda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 61 days.

(21) Appl. No.: 09/756,774

(22) Filed: Jan. 10, 2001

(65) Prior Publication Data

US 2002/0021328 A1 Feb. 21, 2002

(30) Foreign Application Priority Data

Aug. 9, 2000 (JP) ..... P2000-241156

(51) Int. Cl.[7] ..... B41J 3/04
(52) U.S. Cl. ..... 347/46; 347/50
(58) Field of Search ..... 347/7, 46, 47, 347/48, 68; 399/237

(56) References Cited

U.S. PATENT DOCUMENTS

| | | | | |
|---|---|---|---|---|
| 5,657,058 A | * | 8/1997 | Mochizuki et al. | 347/7 |
| 5,831,650 A | * | 11/1998 | Reinten | 347/68 |
| 6,154,235 A | * | 11/2000 | Fukumoto et al. | 347/46 |
| 6,182,907 B1 | | 2/2001 | Nakagawa et al. | |
| 6,269,232 B1 | * | 7/2001 | Fukumoto et al. | 399/237 |

FOREIGN PATENT DOCUMENTS

| | | |
|---|---|---|
| JP | 55-114574 | 9/1980 |
| JP | 9-1793 | 1/1997 |
| JP | 09-1793 | 7/1997 |
| JP | 11-348273 | 12/1999 |

OTHER PUBLICATIONS

H. Fukumoto, et al., IS & Ts NIP 15: International Conference on Digital Printing Technologies, pp. 310–314, "Printing With Ink Mist Ejected By Ultrasonic Waves", 1999.
"Printing with Ink Mist Ejected by Ultrasonic Waves", Hiroshi Fukumoto et al., The Journal of Imagng Science and Technology, vol. 44, No. 5., Sep./Oct. 2000.

* cited by examiner

*Primary Examiner*—Anh T. N. Vo
(74) *Attorney, Agent, or Firm*—Oblon, Spivak, McClelland, Maier & Neustadt, P.C

(57) ABSTRACT

A reflector has an inlet opening toward a piezoelectric element, an outlet opening toward a nozzle plate and a reflecting wall connecting the same with each other. The nozzle plate has a nozzle located in the vicinity of the outlet. The piezoelectric element is provided with a through hole on a position opposed to the outlet, and applies ultrasonic waves to a liquid supplied into the reflector from the through hole. The ultrasonic waves are reflected by the reflecting wall and converged in the vicinity of the outlet for improving acoustic energy on this position so that the nozzle ejects droplets. Thus, the dimension in a direction perpendicular to that for ejecting the droplets is suppressed for providing a droplet ejector having a compact structure.

17 Claims, 11 Drawing Sheets

DROPLET EJECTOR AND LIQUID SUPPLY TUBE

BACKGROUND OF THE INVENTION

1. Field of the Invention

The present invention relates to a technique of ejecting droplets, and is applicable to a technique of ejecting droplets from the forward end of a unidirectionally extending instrument, for example.

2. Description of the Background Art

A technique of vibrating a liquid having an exposed liquid surface with ultrasonic waves from a portion other than the liquid surface for converging acoustic energy in the vicinity of the liquid surface and ejecting droplets from the liquid surface is generally proposed.

FIG. 15 is a sectional view showing the structure of a head 200 for an inkjet printer employed as an example of a conventional droplet ejector. The head 200 comprises an ink tank 201 and a piezoelectric transducer 204 provided on the bottom surface of the ink tank 201.

The ink tank 201 has a cavity for storing ink 203 therein, and a reflecting wall 202 forms the inner wall of this cavity. The cavity is provided on its upper surface, i.e., the side isolated from the bottom surface provided with the piezoelectric transducer 204, with an opening 213 for spraying the ink 203.

The piezoelectric transducer 204 is formed by an electrode 205 and a piezoelectric vibrator 206 connected with wires 208 and 209 respectively. The wires 208 and 209 are connected to an ac power source 207. The electrode 205 is electrically connected with the piezoelectric vibrator 206 and backs the cavity from the bottom surface thereby preventing leakage of the ink 203. An ink inlet 210 is provided on a position of the cavity closest to the electrode 205.

The piezoelectric transducer 204 substantially planarly introduces acoustic waves 211 to the ink 203 and the acoustic waves 211 are reflected by the reflecting wall 202. The reflecting wall 202 presents a parabola on the section shown in FIG. 15 and the opening 213 is arranged in the vicinity of the focus 212 of this parabola, whereby the acoustic waves 211 are converged on the opening 213 for increasing the concentration of acoustic energy of the ink 203 on this portion so that ink droplets DP are sprayed from the opening 213.

For example, Japanese Patent Application Laid-Open No. 10-278253 (1998) discloses such a technique.

On the other hand, the technique of ejecting a liquid is not exclusively required to a printer ejecting ink. For example, it is preferable to eject a desired quantity of liquid from the forward end of a tube having a diameter of several mm in consideration of liquid supply to a narrow portion.

While the aforementioned technique is excellent in the point that the ink inlet 210 is arranged on a position hardly damaging the function of the reflecting wall 202, the direction for introducing the ink 203 into the cavity is along the electrode 205 and substantially perpendicular to the direction for ejecting the droplets DP. Therefore, the dimension along the direction perpendicular to that for ejecting the droplets DP is hard to reduce.

SUMMARY OF THE INVENTION

According to a first aspect of the present invention, a droplet ejector comprises a vibration excitor, a nozzle plate opening a nozzle ejecting a liquid to be ejected and a reflector having an inlet opening toward the vibration excitor, an outlet opening toward the nozzle plate and a reflecting wall storing the liquid, reflecting acoustic waves from the vibration excitor and converging the same in the vicinity of the nozzle, while the vibration excitor is provided with a through hole for supplying the liquid to the reflector.

In the droplet ejector according to the first aspect, the liquid can be directly supplied into the reflector through the through hole of the vibration excitor, whereby the dimension along a direction perpendicular to that for ejecting droplets can be suppressed for providing a droplet ejector having a compact structure. When the outer diameters are equal, therefore, an opening on the inlet side of the reflector can be enlarged for widening the effective reflecting wall. Further, the reflecting wall may not be provided with a hole for liquid supply, whereby stronger ultrasonic waves can be converged for improving efficiency of the apparatus.

According to a second aspect of the present invention, the droplet ejector further comprises a hollow needle engaging with the through hole for supplying the liquid to the reflector.

In the droplet ejector according to the second aspect, the vibration excitor drives no liquid but that stored in the reflector, whereby loss of ultrasonic waves converged in the vicinity of the nozzle can be avoided.

According to a third aspect of the present invention, a forward end of the hollow needle closer to the reflector has an opening whose edge is arranged on a surface of the vibration excitor closer to the reflector.

In the droplet ejector according to the third aspect, the liquid supplied to the reflector spreads on the surface of the vibration excitor to be stored in the reflector from the side separate from the outlet. Therefore, it is possible to inhibit bubbles from remaining around the inlet of the reflector and hindering transmission or convergence of ultrasonic waves.

According to a fourth aspect of the present invention, the hollow needle opens in a plurality of portions toward a plurality of different directions.

In the droplet ejector according to the fourth aspect, the liquid is stored in the reflector without remarkably moving on the surface of the vibration excitor, whereby residual of bubbles can be further suppressed.

According to a fifth aspect of the present invention, the droplet ejector further comprises a liquid storage tank provided on an end of the hollow needle opposite to the reflector.

In the droplet ejector according to the fifth aspect, the liquid storage tank is provided on the back surface of the vibration excitor, whereby liquid supply is simplified and the overall apparatus can be effectively miniaturized.

According to a sixth aspect of the present invention, the through hole has a smaller diameter than the outlet and is provided on a position opposed to the outlet.

In the droplet ejector according to the sixth aspect, ultrasonic waves generated from the position provided with the through hole are not reflected by the reflecting wall but have a small possibility of contributing to convergence of acoustic energy around the nozzle. Therefore, the efficiency for converging the acoustic energy around the nozzle is not remarkably hindered.

According to a seventh aspect of the present invention, the vibration excitor is formed by a plurality of components divided on a boundary including the through hole.

In the droplet ejector according to the seventh aspect, a step of forming the through hole in the vibration excitor can be omitted and the vibration excitor can be prevented from cracking in working.

According to an eighth aspect of the present invention, the droplet ejector further comprises a plurality of conductive members provided on the opposite side of the reflector for supplying a signal to the vibration excitor.

According to a ninth aspect of the present invention, at least one of the plurality of conductive members has a projecting spring member.

According to a tenth aspect of the present invention, all conductive members have projecting spring members.

According to an eleventh aspect of the present invention, at least one of the plurality of conductive members has an extension part extending oppositely to the reflector.

In the droplet ejector according to the eighth to eleventh aspects, both the liquid and a signal to the vibration excitor are supplied from the same side, whereby the liquid and the signal can be supplied to the droplet ejector through a compact structure.

According to a twelfth aspect of the present invention, a liquid supply tube comprises a hollow body supplying a liquid and a plurality of conductors, insulated from each other, provided on the outer side surface of the body.

According to a thirteenth aspect of the present invention, the hollow body is engageable with the hollow needle according to the second aspect of the present invention through a sealing member.

According to a fourteenth aspect of the present invention, the plurality of conductors are capable of conducting with the plurality of conductive members according to the eighth aspect of the present invention.

According to a fifteenth aspect of the present invention, at least one of the plurality of conductors has a contactor projecting toward the plurality of conductive members.

According to a sixteenth aspect of the present invention, at least one of the plurality of conductors is contactable with the extension part according to the eleventh aspect of the present invention on the outer side surface of the body.

In the liquid supply tube according to the twelfth to sixteenth aspects, the body supplies the liquid to the through hole of the droplet ejector according to the first aspect and the conductors can supply a signal to the said vibration excitor. Therefore, the droplet ejector can be readily exchanged with respect to the tube.

An object of the present invention is to provide a droplet ejector having a compact structure by suppressing the dimension of a direction perpendicular to a direction for ejecting droplets.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
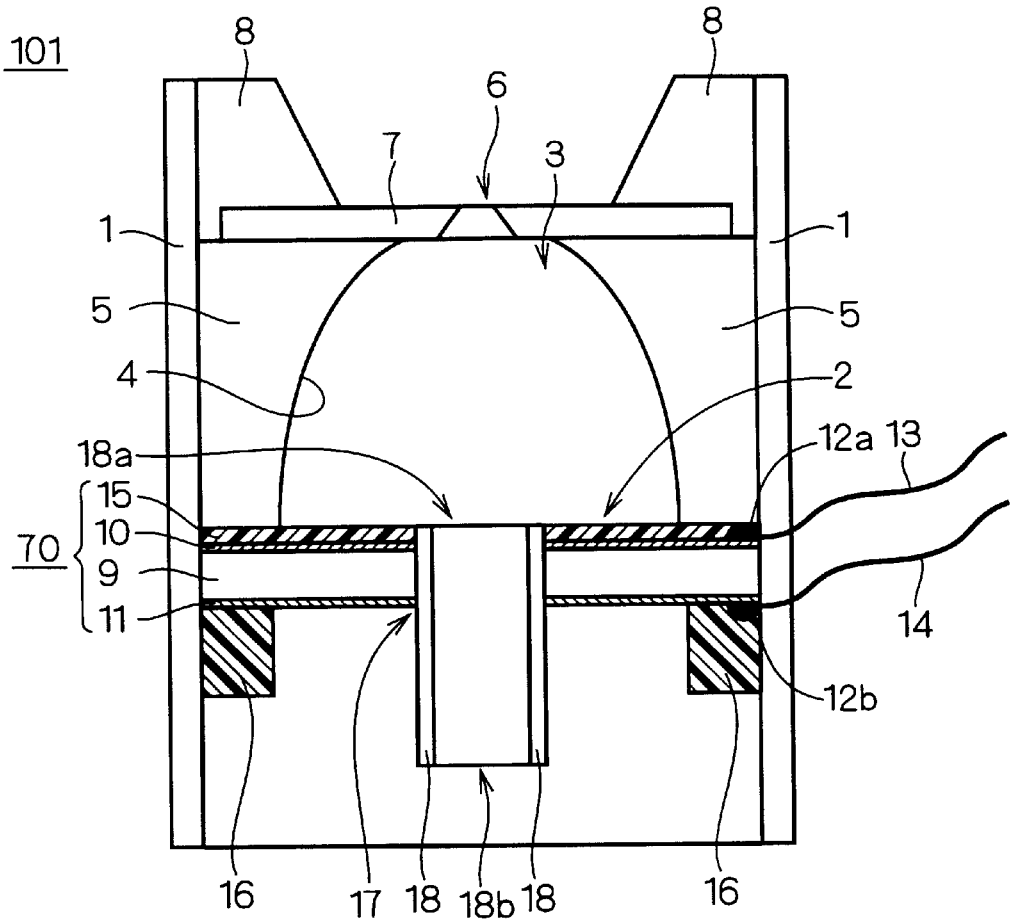
FIG. 1 is a sectional view showing the structure of a droplet ejector according to an embodiment 1 of the present invention.

FIG. 1 is a sectional view showing the structure of a droplet ejector 101 according to an embodiment 1 of the present invention. The droplet ejector 101 comprises a reflector 5 in a cylindrical cover 1. The reflector 5 has an inlet 2 and an outlet 3 on the lower and upper sides of FIG. 1 respectively, as well as a reflecting wall 4 connecting the inlet 2 and the outlet 3 with each other inside the cover 1.

A nozzle plate 7 provided with a nozzle 6 having a smaller opening than the outlet 3 is mounted on the outlet 3 on the opposite side of the inlet 2. The nozzle 6 is inversely tapered to spread toward the reflector 5, for example.

The nozzle plate 7 is so located as to arrange the nozzle 6 in the outlet 3, and a sealing member 8 seals a peripheral portion of the nozzle plate 7 with the reflector 5 and the inner wall of the cover 1. The sealing member 8 is not provided in the vicinity of the nozzle 6, not to hinder the outlet 3 from ejecting droplets.

A piezoelectric element 9 is arranged on the inlet 2 on the opposite side of the outlet 3. The piezoelectric element 9 is provided on the upper surface (closer to the outlet 3) and the lower surface (opposite to the upper surface) thereof, for example, with a ground electrode 10 and a signal electrode 11 respectively by printing, for example. The ground electrode 10 and the signal electrode 11 are connected with a ground wire 13 and a signal wire 14 through connecting terminals 12*a* and 12*b* respectively. A protective film 15 is interposed between the ground electrode 10 and the reflector 5 for preventing a liquid (not shown) stored in the reflector 5 on the side of the reflecting wall 4 from coming into contact with the ground electrode 10.

A multilayer structure 70 formed by the protective film 15, the ground electrode 10, the piezoelectric element 9 and the signal electrode 11 serves as a vibration excitor supplying ultrasonic waves to the liquid stored in the reflector 5 and vibrating the same as a whole. The multilayer structure 70 is pressed against and fixed to the surface of the reflector 5 closer to the outlet 3 with a stopper 16, for example.

Figure 15:
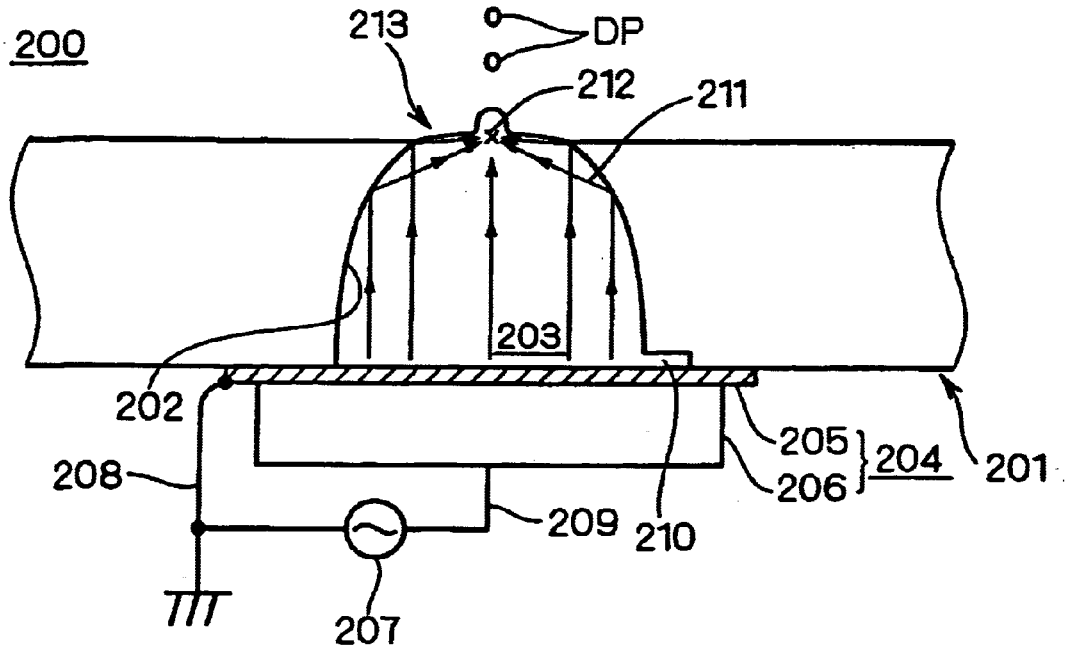
FIG. 15 PRIOR ART
FIG. 15 is a sectional view showing the prior art.

The reflector 5 and the nozzle plate 7 are so designed that ultrasonic waves generated by the multilayer structure 70 are propagated through the liquid stored in the reflector 5, reflected by the reflecting wall 4 and converged in the vicinity of the nozzle 6. The technique shown in FIG. 15 can be employed for converging the ultrasonic waves in the vicinity of the nozzle 6 and ejecting droplets from the nozzle 6 toward a side opposite to an ultrasonic generator. The reflecting wall 4 is a paraboloid of revolution, for example, and a larger-diametral side of the nozzle 6 is arranged in the vicinity of the focus of the paraboloid of revolution.

Figure 2:
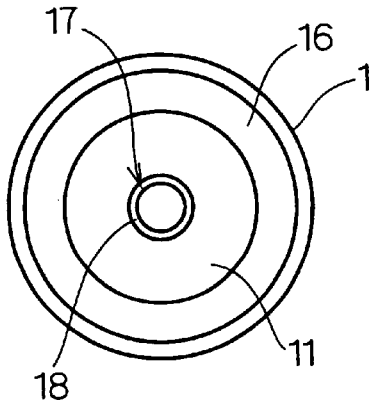
FIG. 2 is a bottom plan view showing the structure of the droplet ejector according to the embodiment 1 of the present invention.

FIG. 2 is a bottom plan view of the droplet ejector 101 as viewed from the side of the stopper 16. As shown in FIGS. 1 and 2, the multilayer structure 70 has a through hole 17 in the droplet ejector 101, and a hollow needle 18 having openings 18*a* and 18*b* on the side closer to the reflector 5 and the side opposite thereto respectively is engaged with the through hole 17. The liquid can be introduced from the opening 18*b* to be introduced into the reflector 5 through the opening 18*a*.

Thus, the direction for ejecting droplets from the outlet 3 can be substantially parallelized with the direction of the liquid supplied to the inlet 2, thereby suppressing the dimension along the direction perpendicular to that for ejecting the droplets, i.e., the diameters of the reflector 5 as well as the cover 1. In other words, the inlet 2 can be widened for widening the effective area of the reflecting wall 4 if the diameter of the cover 1 is equal. Desirably, the through hole 17 has a smaller diameter than the outlet 3 and is arranged in opposition to the outlet 3. Even if ultrasonic waves are generated from such a position, the ultrasonic waves are not reflected by the reflecting wall 4 but have a small possibility of contributing to convergence of acoustic energy in the vicinity of the nozzle 6. Also when providing the through hole 17 and arranging the hollow needle 18 on such a position, therefore, efficiency for converging the acoustic energy in the vicinity of the nozzle 6 is not largely hindered.

Figure 3:
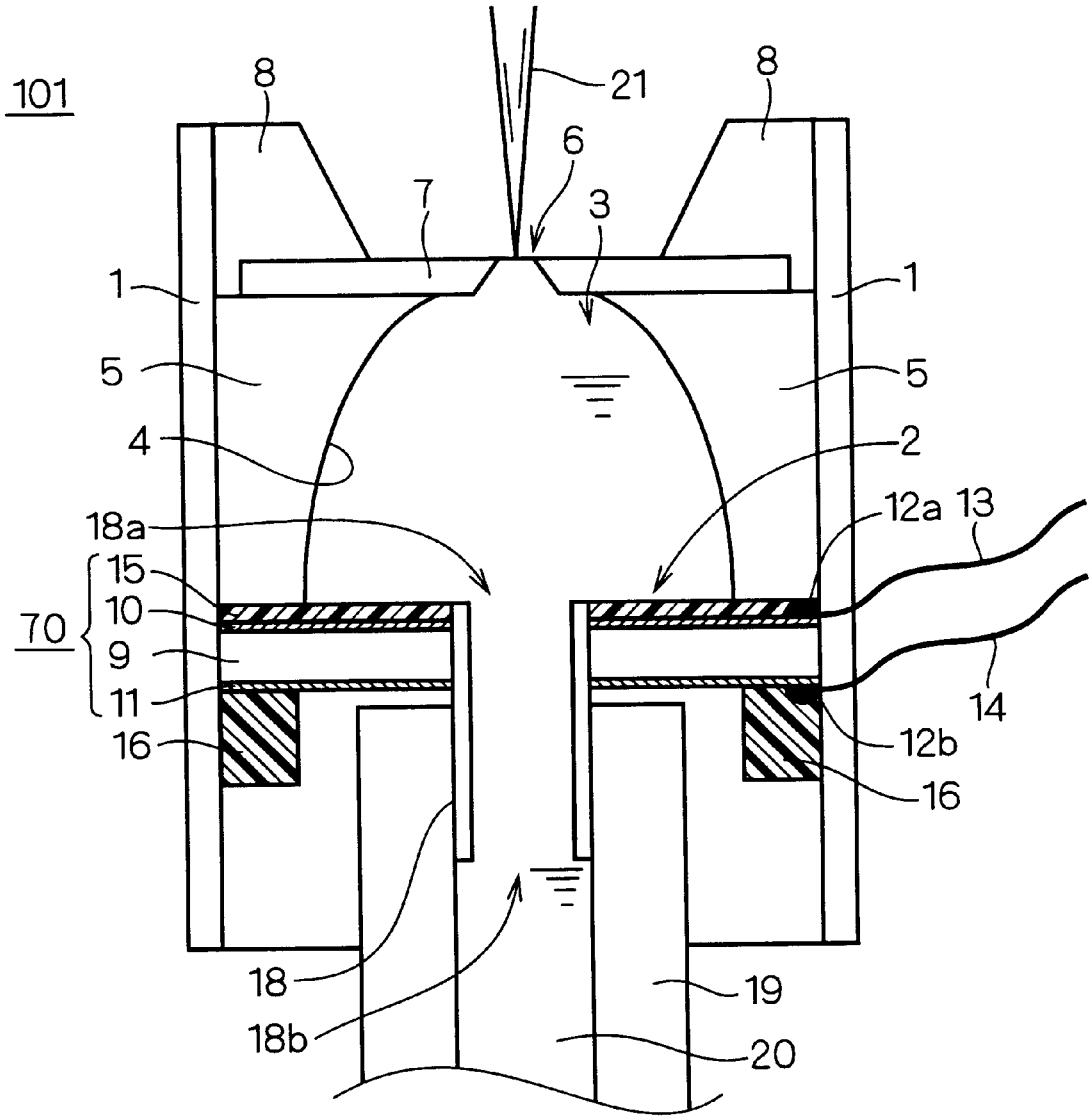
FIG. 3 is a sectional view conceptually showing operations of the droplet ejector according to the embodiment 1 of the present invention.

FIG. 3 is a sectional view conceptually showing operations of the droplet ejector 101. The hollow needle 18 supplies a liquid 20 into the reflector 5. The piezoelectric element 9 is driven by driving signals from the ground wire 13 and the signal wire 14 for generating ultrasonic waves. The generated ultrasonic waves are propagated through the liquid 20, reflected by the reflecting wall 4 and converged in the vicinity of the nozzle 6 for vibrating the liquid surface exposed on the nozzle 6 and separating fine droplets. A group of the separated fine droplets is ejected as a mist flow 21 having directivity.

A tube 19 is engaged with and mounted on the side of the hollow needle 18 closer to the opening 18*b* for supplying the liquid 20 into the hollow needle 18. Therefore, the liquid 20 will not come into contact with the lower surface of the multilayer structure 70, i.e., the signal electrode 11. As the first effect, the signal electrode 11 may not be provided with a film protecting the same against the liquid 20. As the second effect, the multilayer structure 70 drives no liquid but the liquid 20 stored in the reflector 5, and hence loss of the ultrasonic waves converged in the vicinity of the nozzle 6 can be avoided. Further, the droplets can be ejected to a narrow portion by reducing the outer diameter of the tube 19 below the inner diameter of the cover 1.

While the piezoelectric element 9 is provided with the ground electrode 10 and the signal electrode 11 on the side closer to the reflector 5 and the side opposite side thereto respectively in this embodiment, the effect of ejecting the droplets is not damaged by replacing the wires with each other, as a matter of course.

The stopper 16 may not be a single coupler but may alternatively have a structure of pressing the multilayer structure 70 against the reflector 5 on a plurality of portions.

Desirably, the edge of the opening 18*a* of the hollow needle 18 is arranged in coincidence with the surface of the multilayer structure 70, serving as a vibration excitor, closer to the reflector 5, e.g., the surface of the protective film 15. Thus, the liquid 20 supplied to the reflector 5 spreads on the protective film 15 to be stored in the reflector 5 from the side of the reflecting wall 4 separate from the outlet 3. Therefore, bubbles can be inhibited from remaining in the vicinity of the inlet 2 of the reflector 5. Due to such suppression of the bubbles, a step of removing the bubbles can be omitted when initially charging the liquid 20 in the reflector 5 so that the liquid 20 can be quickly and reliably initially charged. If the bubbles remain in the reflector 5, transmission or convergence of the ultrasonic waves is hindered and the efficiency of ejecting the droplets is deteriorated. In order to attain high reliability and stable performance, therefore, the aforementioned suppression of the bubbles is remarkably advantageous.

Embodiment 2

Figure 4:
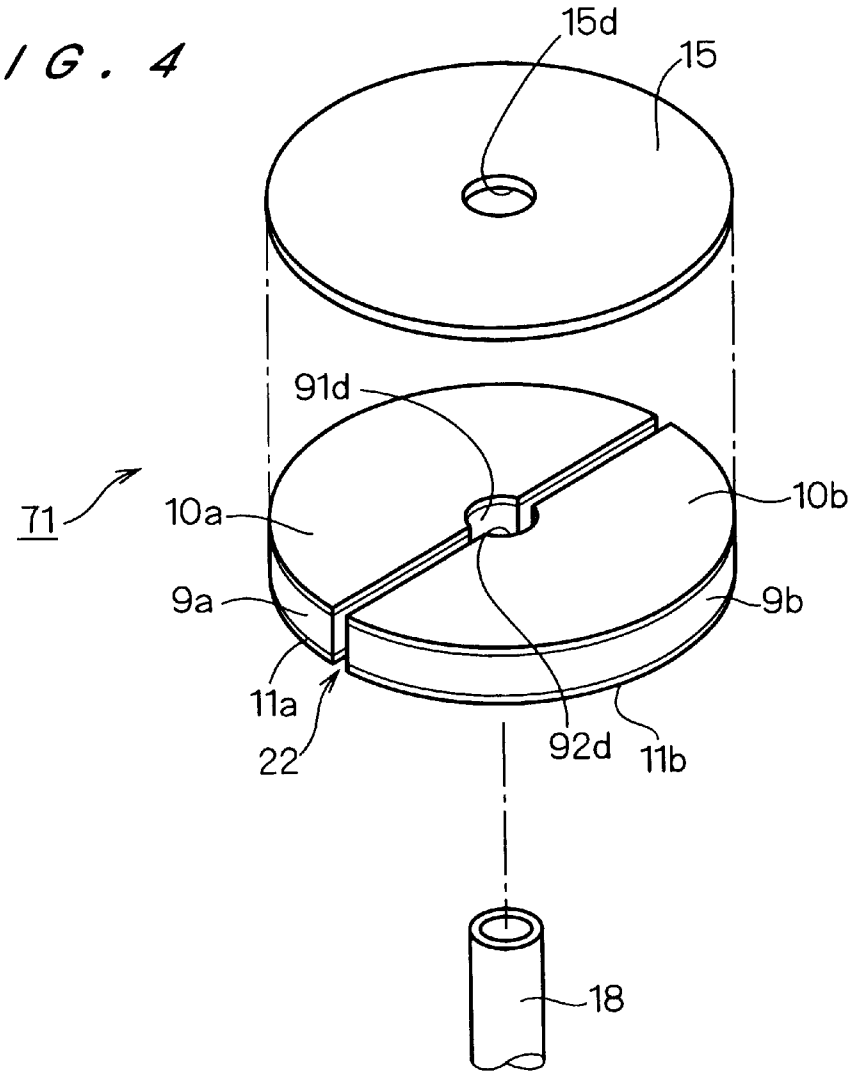
FIG. 4 is a perspective view showing the structure of a droplet ejector according to an embodiment 2 of the present invention.

FIG. 4 is a perspective view showing the structures of a multilayer structure 71 and a hollow needle 18 of a droplet ejector according to an embodiment 2 of the present invention. This embodiment is different from the embodiment 1 in a point that the piezoelectric element 9 in the embodiment 1 is formed by a plurality of, e.g., two piezoelectric elements 9*a* and 9*b*.

The multilayer structure 71, formed by substantially semicircular piezoelectric elements 9*a* and 9*b* and a circular protective film 15, is employable in place of the multilayer structure 70 according to the embodiment 1. A ground electrode 10*a* and a signal electrode 11*a* are provided on the upper and lower surfaces of the piezoelectric element 9*a* while a ground electrode 10*b* and a signal electrode 11*b* are provided on the upper and lower surfaces of the piezoelectric element 9*b* respectively by printing, for example. The piezoelectric elements 9*a* and 9*b* are provided with substantially semicircular notches 91*d* and 92*d* respectively. The protective film 15 has a hole 15*d*.

In order to assemble the multilayer structure 71 and the hollow needle 18, the hollow needle 18 is brought into contact with the notches 91*d* and 92*d*, held between the piezoelectric elements 9*a* and 9*b* and engaged in the hole 15*d*. The notches 91*d* and 92*d* and the hole 15*d* define a through hole similar to the through hole 17 according to the embodiment 1. In other words, it follows that a plurality of piezoelectric elements divided through a boundary including the through hole similar to the through hole 17 are combined with each other to hold the hollow needle 18 therebetween.

Due to such assembling, it is not necessary to dig the through hole 17 in the piezoelectric element 9 by later working. Therefore, steps of preparing the piezoelectric element 9 are simplified while breakage of the piezoelectric element 9 generally made of ceramic can be avoided. The hollow needle 18 may alternatively be engaged in the hole 15*d* first, to be thereafter held between the piezoelectric elements 9*a* and 9*b*.

A clearance 22 may be or may not be defined between the piezoelectric elements 9*a* and 9*b* after assembling the multilayer structure 71. In either case, it is preferable to externally connect a ground wire 13 and a signal wire 14 to the ground electrodes 10*a*, 10*b* and the signal electrodes 11*a*, 11*b* respectively.

The protective film 15 is preferably formed by a single coupler, not to be divided. Thus, the protective film 15 attains a function of sealing ink 20 stored in a reflector 5 not to leak from an inlet 2.

Embodiment 3

Figure 5:
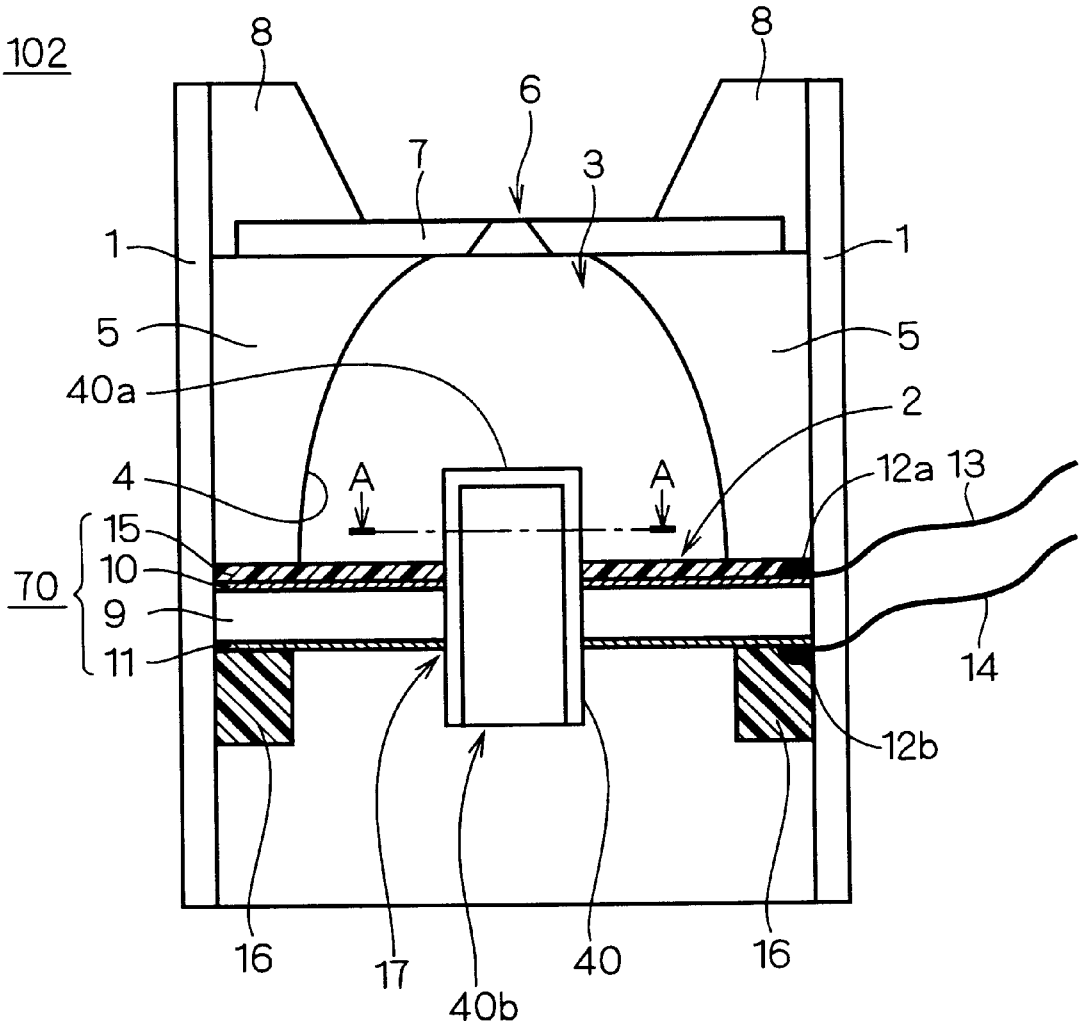
FIGS. 5 to 9 are sectional views showing exemplary structures of a droplet ejector according to an embodiment 3 of the present invention.
Figure 6:
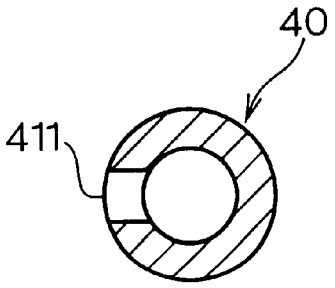
Figure 7:
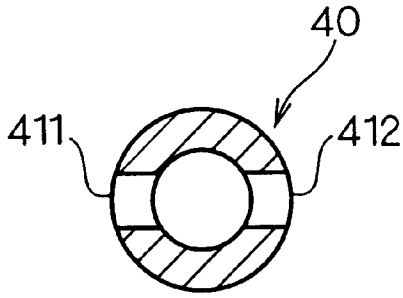
Figure 8:
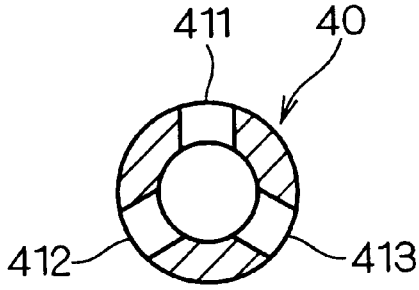
Figure 9:
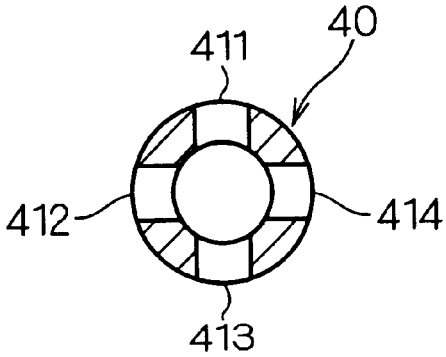

FIG. 5 is a sectional view showing the structure of a droplet ejector 102 according to an embodiment 3 of the present invention. The droplet ejector 102 has a structure obtained by replacing the hollow needle 18 of the droplet ejector 101 with a hollow needle 40. The hollow needle 40 also passes through a multilayer structure 70 through a through hole 17, while its forward end 40*a* is not open but its side surface is open.

FIGS. 6 to 9 are sectional views showing various modes of a section of the hollow needle 40 taken along the line A—A in FIG. 5. The hollow needle 40 has a unidirectional opening 411 in the structure shown in FIG. 6, bi-directional openings 411 and 412 in the structure shown in FIG. 7, three-directional openings 411, 412 and 413 in the structure shown in FIG. 8, and four-directional openings 411, 412, 413 and 414 in the structure shown in FIG. 9.

Desirably in this embodiment, lower ends (positions most separate from an outlet 3) of edges of the openings 411, 412, 413 and 414 are arranged in coincidence with the surface of the multilayer structure 70, serving as a vibration excitor, closer to a reflector 5 such as a surface of a protective film 15, for example, similarly to the edge of the opening 18*a* of the hollow needle 18. When supplied to the reflector 5, a liquid 20 spreads on the protective film 15 to be stored in the reflector 5 from a side of a reflecting wall 4 separate from the outlet 3, as described with reference to the embodiment 1. Therefore, bubbles can be inhibited from remaining in the vicinity of an inlet 2 of the reflector 5.

Particularly when a plurality of openings are provided toward different directions, the liquid 20 is stored in the reflector 5 without largely moving on the surface of the protective film 15, whereby bubbles can be further inhibited from remaining.

Embodiment 4

Figure 10:
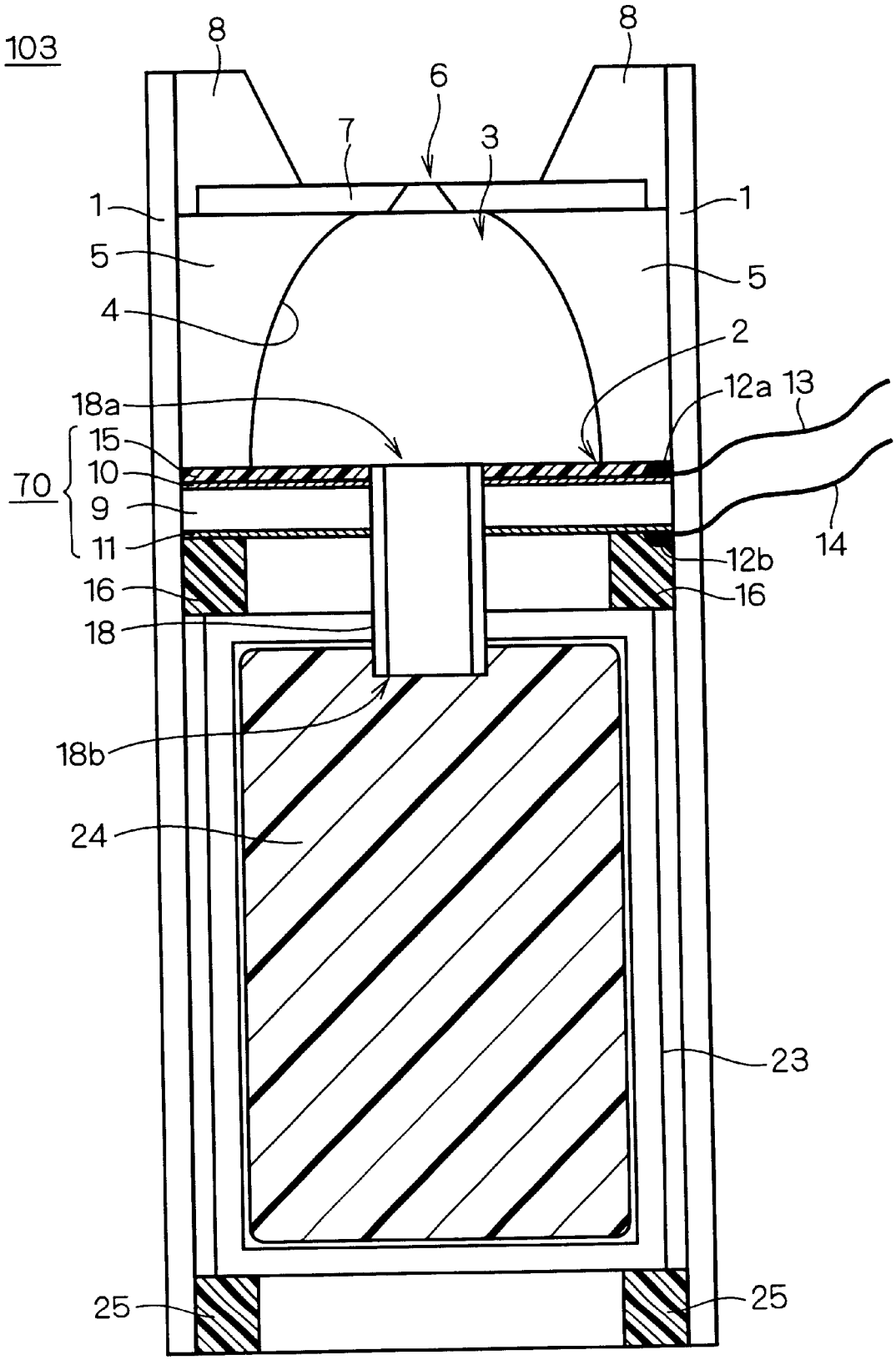
FIG. 10 is a sectional view showing the structure of a droplet ejector according to an embodiment 4 of the present invention.

FIG. 10 is a sectional view showing the structure of a droplet ejector 103 according to an embodiment 4 of the present invention. The droplet ejector 103 has a structure obtained by adding a tank 23 and a stopper 25 to the droplet ejector 101.

The tank 23 stores a porous absorber 24 such as a sponge absorbing and holding a liquid. Further, the tank 23 is held in a cover 1 with a stopper 16 and the stopper 25, for receiving an opening 18*b* of a hollow needle 18 therein.

According to this structure, the liquid to be ejected may not be supplied from outside the droplet ejector 103 but the overall apparatus can be miniaturized.

Embodiment 5

Figure 11:
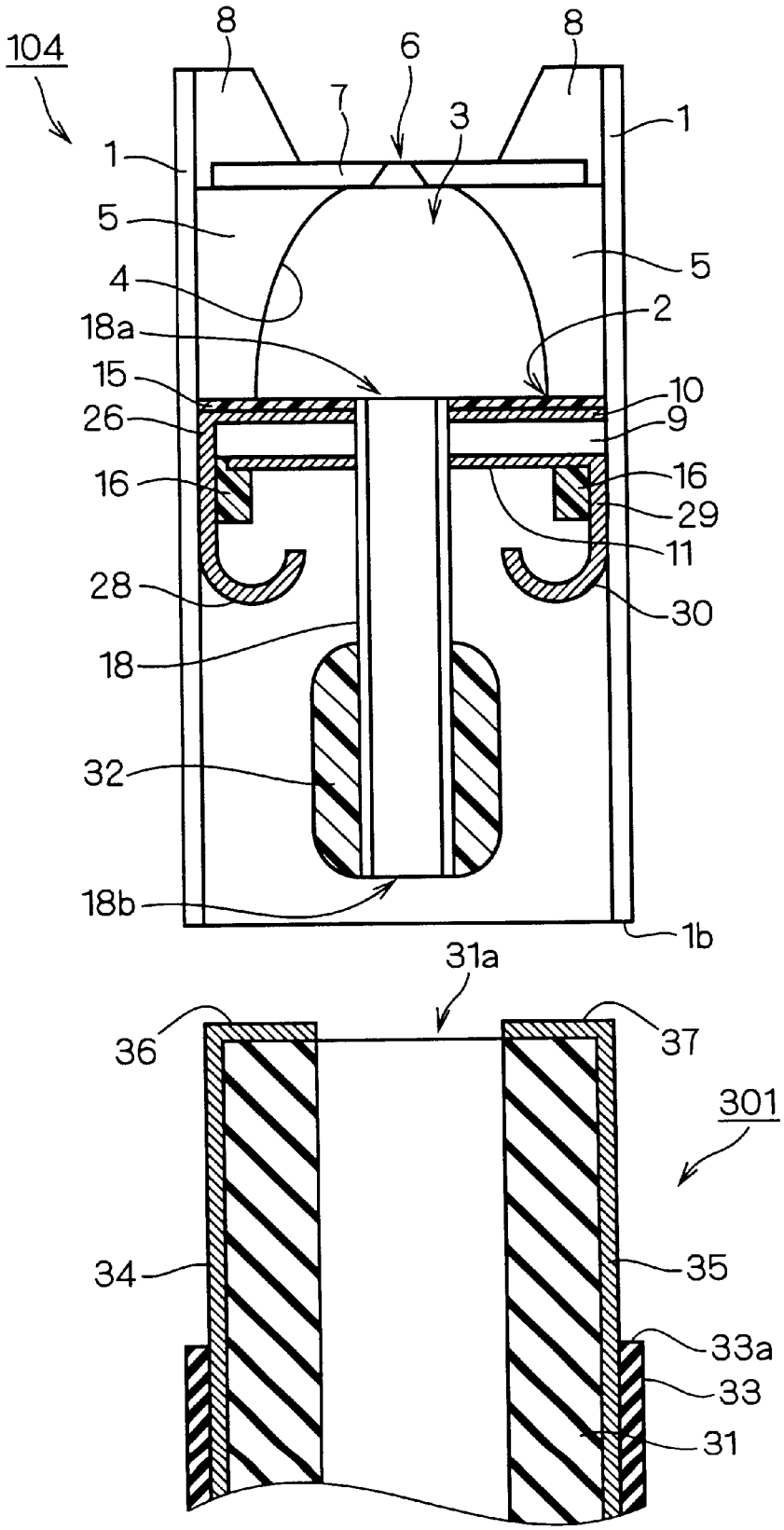
FIG. 11 is a sectional view showing the structure of a droplet ejector according to an embodiment 5 of the present invention.

FIG. 11 is a sectional view showing the structure of a droplet ejector 104 according to an embodiment 5 of the present invention and that of a tube 301 engaging with the droplet ejector 104 for supplying a liquid. The droplet ejector 104 is different from the droplet ejector 101 in a point that the ground wire 13 and the signal wire 14 are replaced with conductive spring members 26 and 29 and the outer side surface of a hollow needle 18 is covered with a sealing member 32 in the vicinity of an opening 18*b*.

The spring member 26 has an end conducting with a ground electrode 10 and another end formed with a contactor 28. The spring member 29 has an end conducting with a signal electrode 11 and another end formed with a contactor 30. The spring members 26 and 29 are fixed to the inner wall of a cover 1 by a stopper 16, for example, and provided on the opposite side to a reflector 5 in relation to a piezoelectric element 9.

The spring member 26 extends from the side of the ground electrode 10 toward the side of the signal electrode 11 through the side surface of the piezoelectric element 9, and hence the signal electrode 11 is not formed in the vicinity of the spring member 26, in order to avoid conduction with the spring member 26.

The tube 301 has an insulating hollow body 31 opening at least on an end 31*a*, and is provided on its outer side surface with a ground wire 34 and a signal wire 35 insulated from each other. The ground wire 34 and the signal wire 35 are covered with a coating 33. An end surface 33*a* of the coating 33 is retracted from an end 31*a* of the body 31. The ground wire 34 and the signal wire 35 are connected with contacts 36 and 37 provided on the end 31*a*.

Figure 12:
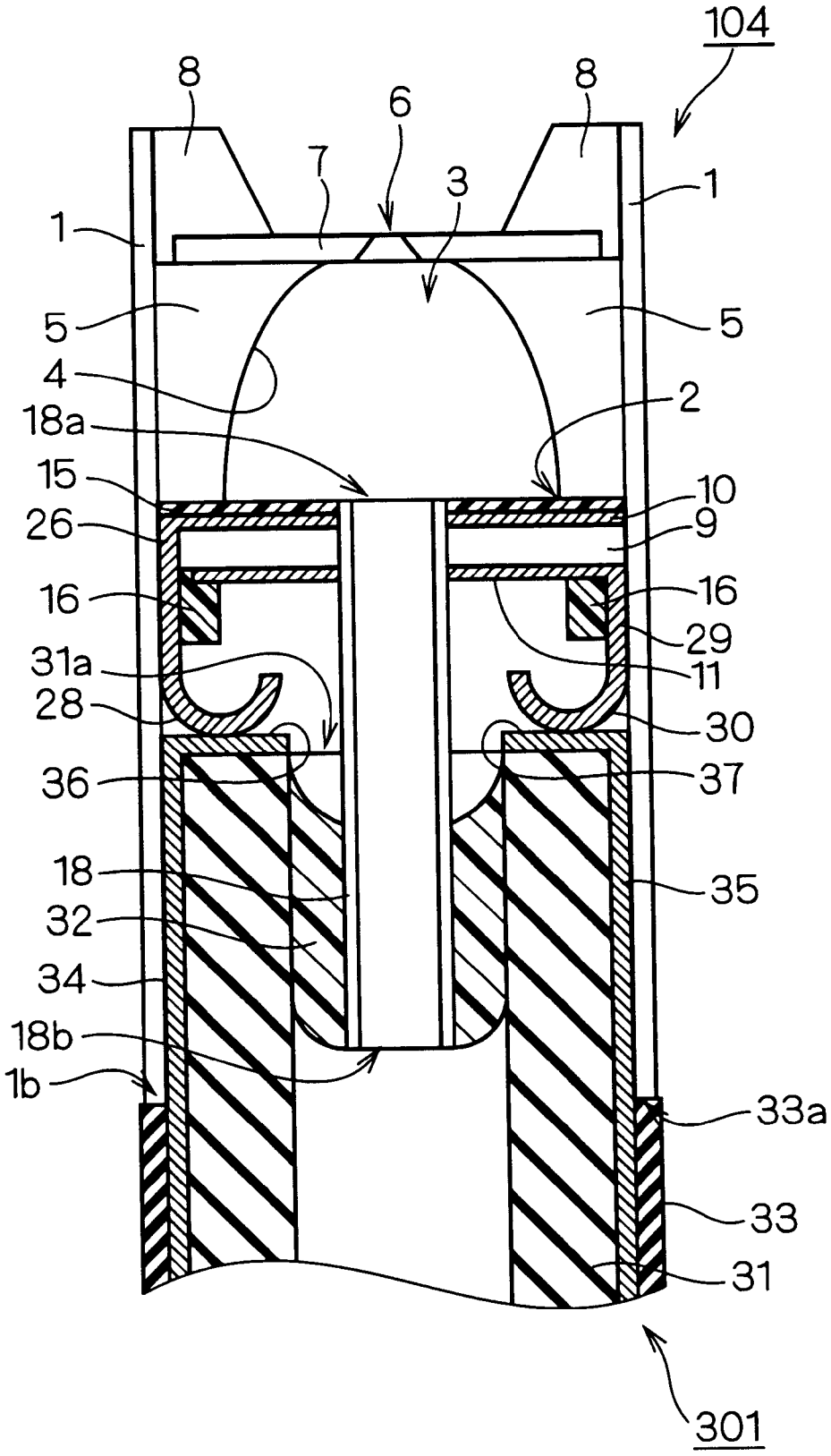
FIG. 12 is a sectional vie showing a working state of the droplet ejector according to the embodiment 5 of the present invention.

FIG. 12 is a sectional view showing the droplet ejector 104 coupled with the tube 301. The tube 301 is pushed from the side of an end 1*b* of the cover 1 separate from a nozzle 6 thereby inserting the hollow needle 18 into the body 31 through a sealing member 32 so that a liquid can be supplied from the tube 301 to a reflector 5. Further, the contactors 28 and 30 come into contact with the contacts 36 and 37 respectively for attaining electrical connection. When coupling the droplet ejector 104 with the tube 301, the piezoelectric element 9 can be driven with the ground wire 34 and the signal wire 35. Further, the liquid can be supplied from the body 31 into the reflector 5.

The dimensions of the respective parts can be properly designed and implemented in order to attain the aforementioned contact relation while bringing the end 1*b* and the end surface 33*a* into contact with each other. The coating 33 may be omitted and the hollow needle 18 may be inserted into the body 31 through the sealing member 32 while bringing the contactors 28 and 30 with the contacts 36 and 37 into contact with each other respectively.

The dimensions of the tube 301, including the ground wire 34 and the signal wire 35, and the cover 1 can be so designed as to engage the outer side surface of the tube 301 with the cover 1 with no clearance. In this case, the droplet ejector 104 is held by the tube 301 so that these can be integrally handled.

According to this embodiment, the conductive spring members 26 and 29 supplying signals for driving the piezoelectric element 9 are provided on the opposite side to the reflector 5, whereby the side supplying the liquid can be matched with the side supplying the signals to the piezoelectric element 9. Thus, the tube 301 having a compact structure can supply the liquid and the signals to the droplet ejector 104.

It is possible to attain electrical connection, supply the liquid and hold the droplet ejector 104 by simply coupling the tube 301 to the droplet ejector 104. Thus, the droplet ejector 104 and the tube 301 can be quickly and simply attached to/detached from each other, to be readily exchanged.

The outer diameter of the tube 301 including the coating 33 can be designed identically to the outer diameter of the droplet ejector 104. In this case, no step is caused between the outer side surfaces thereof, whereby a possibility of being caught can be reduced also when the droplet ejector 104 and the tube 301 are inserted and used in a narrow portion. Further, it is also possible to insert the droplet ejector 104 and the tube 301 in a winding narrow portion by providing the tube 301 with flexibility.

Embodiment 6

Figure 13:
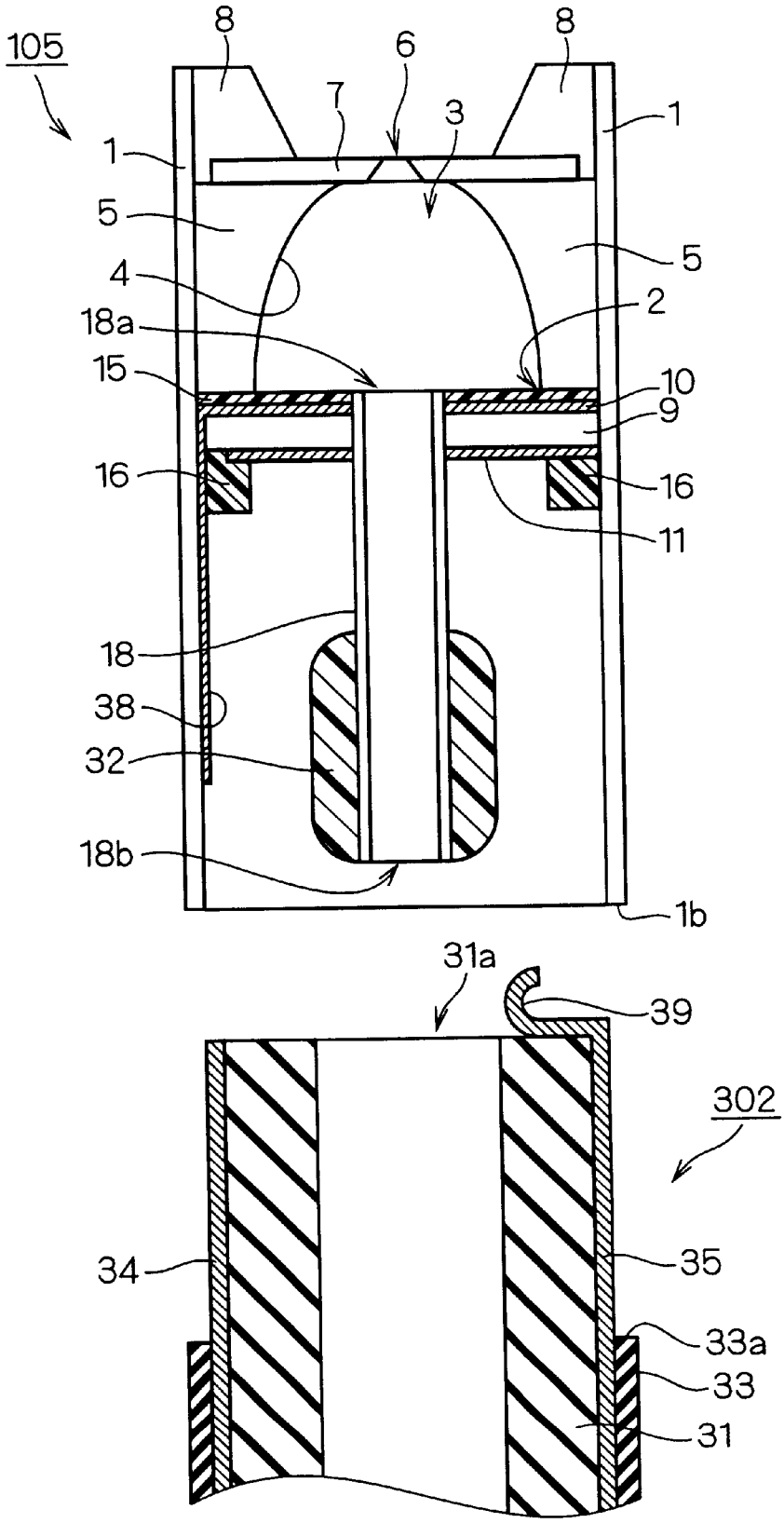
FIG. 13 is a sectional view showing the structure of a droplet ejector according to an embodiment 6 of the present invention.

FIG. 13 is a sectional view showing the structure of a droplet ejector 105 according to an embodiment 6 of the present invention and that of a tube 302 engaging with the droplet ejector 105 for supplying a liquid. The droplet ejector 105 has a structure obtained by replacing the spring member 26 of the droplet ejector 104 with a conductive contact plate 38 while omitting the spring member 29. The contact plate 38 has an end conducting with a ground electrode 10 and another end extending along the inner wall of a cover 1. The contact plate 38 also extends from the side of a ground electrode 10 to the side of a signal electrode 11 through the side surface of a piezoelectric element 9 similarly to the spring member 26, and hence the signal electrode 11 is not formed in the vicinity of the contact plate 38, in order to avoid conduction with the contact plate 38.

The tube 302 has a structure obtained by omitting the contact 36 in the tube 301 while replacing the contact 37 with a contactor 39 projecting from an end 31*a*. The signal wire 35 conducts with, e.g., is coupled with the contactor 39.

Figure 14:
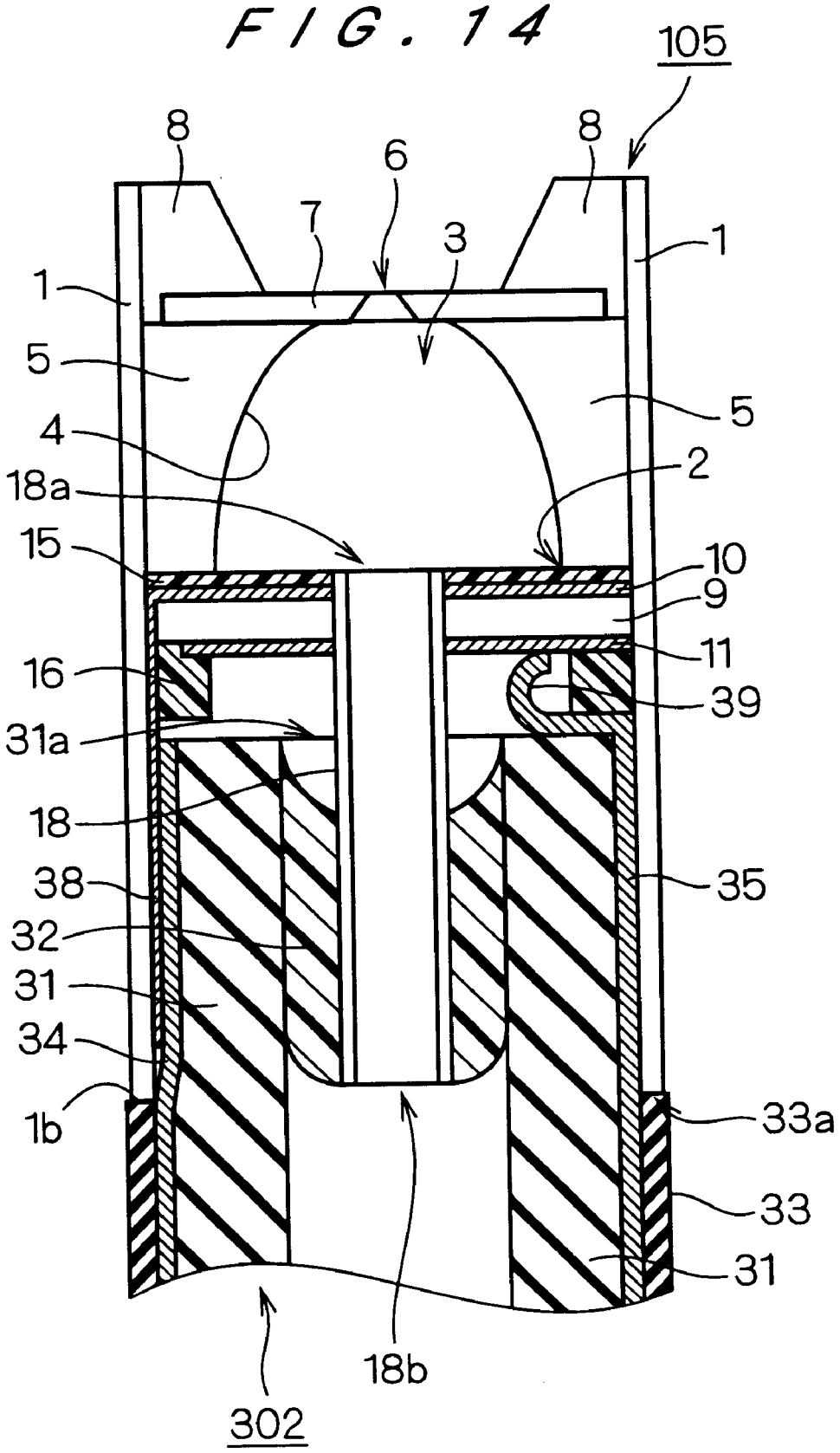
FIG. 14 is a sectional view showing a working state of the droplet ejector according to the embodiment 6 of the present invention.

FIG. 14 is a sectional view showing the droplet ejector 105 coupled with the tube 302. Similarly to the embodiment 5, the tube 302 is pushed from the side of an end 1*b* for inserting a hollow needle 18 into a body 31 through a sealing member 32 so that the liquid can be supplied from the tube 302 to a reflector 5.

A ground wire 34 is mounted on the contact plate 38 to contact therewith, and the contactor 39 is also in direct contact with a signal electrode 11. In order to secure such contact, the contactor 39 desirably has elasticity.

Also in this structure, the side supplying the liquid can be matched with a side supplying a signal to a piezoelectric element 9 similarly to the embodiment 5, for attaining a similar effect.

A contactor 28 and a contact 36 may be employed for conduction with respect to the ground electrode 10, as shown in FIG. 12. The employed structures may be replaced for conduction with respect to the ground electrode 10 and conduction with respect to the signal electrode 11, as a matter of course.

While the invention has been shown and described in detail, the foregoing description is in all aspects illustrative and not restrictive. It is therefore understood that numerous modifications and variations can be devised without departing from the scope of the invention.

What is claimed is:

1. A droplet ejector comprising:

a vibration excitor;

a nozzle plate opening a nozzle ejecting a liquid; and a reflector having an inlet opening toward said vibration excitor, an outlet opening toward said nozzle plate and a reflecting wall, said reflector storing said liquid, and said reflecting wall reflecting acoustic waves from said vibration excitor and converging said acoustic waves in the vicinity of said nozzle, wherein said vibration excitor is provided with a through hole for supplying said liquid to said reflector and a hollow needle engaging with said through hole for supplying said liquid to said reflector.

2. The droplet ejector according to claim 1, wherein an end of said hollow needle closer to said reflector has an opening whose edge is arranged on a surface of said vibration excitor closer to said reflector.

3. The droplet ejector according to claim 2, wherein said hollow needle opens in a plurality of portions toward a plurality of different directions.

4. The droplet ejector according to claim 1, further comprising:

a liquid storage tank provided on another end of said hollow needle opposite to said reflector.

5. The droplet ejector according to claim 1, wherein said through hole has a smaller diameter than said outlet and is provided on a position opposed to said outlet.

6. The droplet ejector according to claim 1, wherein said vibration excitor is divided into a plurality of components on a boundary including said through hole, the plurality of components including a ground electrode, a piezoelectric element, and a signal electrode.

7. The droplet ejector according to claim 1, further comprising:

a plurality of conductive members provided on the opposite side to said reflector for supplying a signal to said vibration excitor.

8. The droplet ejector of claim 1, wherein said vibration excitor comprises an ultrasonic wave generator.

9. The droplet ejector of claim 1, wherein said reflecting wall comprises a surface defined by a paraboloid of revolution.

10. A The droplet ejector according to claim 1, further comprising:

a vibration excitor;

a nozzle plate opening a nozzle ejecting a liquid;

a reflector having an inlet opening toward said vibration excitor, an outlet opening toward said nozzle plate and a reflecting wall, said reflector storing said liquid, and said reflecting wall reflecting acoustic waves from said vibration excitor and converging said acoustic waves in the vicinity of said nozzle; and a plurality of conductive members provided on the opposite side to said reflector for supplying a signal to said vibration excitor, wherein said vibration excitor is provided with a through hole for supplying said liquid to said reflector.

11. The droplet ejector according to claim 10, wherein at least one of said plurality of conductive members has an extension part extending oppositely to said reflector.

12. The droplet ejector according to claim 10, wherein at least one of said plurality of conductive members has a projecting spring member.

13. The droplet ejector according to claim 12, wherein all said plurality of conductive members have projecting spring members.

14. A liquid supply tube comprising:

a hollow body supplying a liquid; and a plurality of conductors, insulated from each other, provided on the outer side surface of said body, wherein, said plurality of conductors are capable of conducting with a plurality of conductive members provided on an opposite side to a reflector for supplying a signal to a vibration excitor, said reflector stores said liquid and has a reflecting wall, and said reflecting wall reflects acoustic waves from said vibration excitor.

15. The liquid supply tube according to claim 14, wherein at least one of said plurality of conductors has a contactor projecting toward said plurality of conductive members.

16. The liquid supply tube according to claim 14, wherein, at least one of said plurality of conductors is contactable with an extension part on said outer side surface of said body, at least one of said plurality of conductive members has said extension part, and said extension part extends oppositely to said reflector.

17. A liquid supply tube comprising:

a hollow body supplying a liquid; and a plurality of conductors, insulated from each other, provided on the outer side surface of said hollow body, wherein:

said hollow body is engageable with a hollow needle, said hollow needle engaging with a through hole provided in a vibration excitor and supplying said liquid to a reflector, said plurality of conductors are capable of conducting with a plurality of conductive members on an opposite side to said reflector for supplying a signal to said vibration excitor, said reflector stores said liquid and has a reflecting wall, and said reflecting wall reflects acoustic waves from said vibration excitor.

* * * * *